US005490438A

United States Patent [19]

Zupo et al.

[11] Patent Number: 5,490,438

[45] Date of Patent: Feb. 13, 1996

[54] TOOL FOR REMOVING BROKEN LIGHT BULBS

[75] Inventors: Alan L. Zupo, Markham; Roger G. Brown, Willowdale, both of Canada

[73] Assignee: Socket Butler Inc., Concord, Canada

[21] Appl. No.: 350,857

[22] Filed: Dec. 7, 1994

[51] Int. Cl.[6] ..... H01K 3/32

[52] U.S. Cl. ..... 81/53.11; 81/64; 81/448

[58] Field of Search ..... 81/53.1, 53.11, 81/64, 448, 449

[56] References Cited

U.S. PATENT DOCUMENTS

| | | | |
|---|---|---|---|
| 1,319,028 | 10/1919 | Grinnell | 81/53.11 X |
| 2,117,017 | 5/1938 | Chadsey | 81/53.11 |
| 2,516,650 | 7/1950 | Shapiro et al. | 81/53.11 X |
| 4,485,701 | 12/1984 | Hough | 81/64 |

*Primary Examiner*—James G. Smith
*Attorney, Agent, or Firm*—Mark B. Eisen

[57] ABSTRACT

A tool for removing a broken incandescent light bulb has a handle with a head projecting therefrom and preferably a resilient gripping member which snugly enshrouds the head, to frictionally engage an inner wall of the base of a broken light bulb such that when the tool is rotated the base can be dislodged from a light bulb socket. In a preferred embodiment a collar with stiffening ribs surrounds the tool, positioned to protect the user's hand from falling shards of glass. In a further preferred embodiment an accessory tool having one or more heads of different sizes is adapted to fit within a hollow end of the handle.

19 Claims, 4 Drawing Sheets

TOOL FOR REMOVING BROKEN LIGHT BULBS

FIELD OF THE INVENTION

This invention relates to tools. In particular, this invention relates to a tool for removing a broken light bulb from its socket.

BACKGROUND OF THE INVENTION

Incandescent lights are still a popular form of lighting, particularly in residential premises. A typical incandescent light bulb, illustrated in FIG. 6, consists of a metallic base 2, usually threaded, and a contact 3 insulated from the base. A pair of lead-in wires 4 project from the base 2 and the contact 3, respectively, into a glass bulb 5 adhesively affixed to the base 2 which is either depressurized or less frequently filled with an inert gas. Usually the lead-in wires 4 project through a pinch 6 in the throat of the bulb, which helps to maintain the orientation of the lead-in wires 4 and provide an airtight seal at their point of entry into the bulb 5. A filament 7 extends between the lead-in wires, and when an electric current is applied through the filament it glows to produce light.

Most individuals responsible for replacing light bulbs in a residential premises have experienced the frustration of trying to remove a broken light bulb from its socket. Particularly in the case of a depressurized bulb, when broken the glass bulb tends to implode catastrophically, shattering virtually any portion of the bulb which is not affixed to the base. If the base is properly screwed into its socket, it is extremely difficult to grip the base sufficiently to dislodge it from the socket. Generally the only remaining portions of the light bulb which projects from the socket are the pinch and lead-in wires, which cannot withstand the pressure of rotating the base to dislodge the base from the socket.

The usual solution is to deactivate the circuit powering the light, and try to grip the metallic base with a needlenose pliers in an effort to rotate the base out of the socket. This can be rather difficult, and dangerous for a number of reasons. There is risk of electrocution if the power has not been properly cut off from the light. Small shards of glass projecting from the base can easily cut the hand of a person attempting to remove the broken light bulb in this fashion, or can fall onto the person during the process. Moreover, the metal of the base is not very thick and is readily deformed, which can result in the base becoming jammed in the socket.

SUMMARY OF THE INVENTION

The present invention overcomes these disadvantages by providing a tool for removing a broken light bulb from a socket. The tool is sufficiently rigid to enable a user to properly grip the tool, while the head of the tool is sufficiently resilient to enable the tool to frictionally grip the base of the light bulb for rotation out of the socket. The head of the standard tool is provided with an orifice into which the lead-in wires and pinch of the light bulb project during removal, thus avoiding further breakage of glass in the process, and is dimensioned to fit the base of a standard ("regular" or "Edison base") light bulb. To accommodate different sizes of light bulb bases, an accessory tool having small ("intermediate") and miniature ("candelabra") size heads is stored in the handle of the standard tool having a standard size head, thus providing a convenient all-purpose broken light bulb removing tool.

The present invention thus provides a tool for removing a broken incandescent light bulb from a socket, comprising a handle having a head projecting from one end, the head being dimensioned to fit within a base of the light bulb, whereby when the head is inserted into the base of a broken light bulb the head frictionally engages an inner wall of the base to permit rotation of the base within the socket by rotating the handle.

BRIEF DESCRIPTION OF THE DRAWINGS

In drawings which illustrate by way of example only a preferred embodiment of the invention.

DETAILED DESCRIPTION OF THE DRAWINGS

Figure 1:
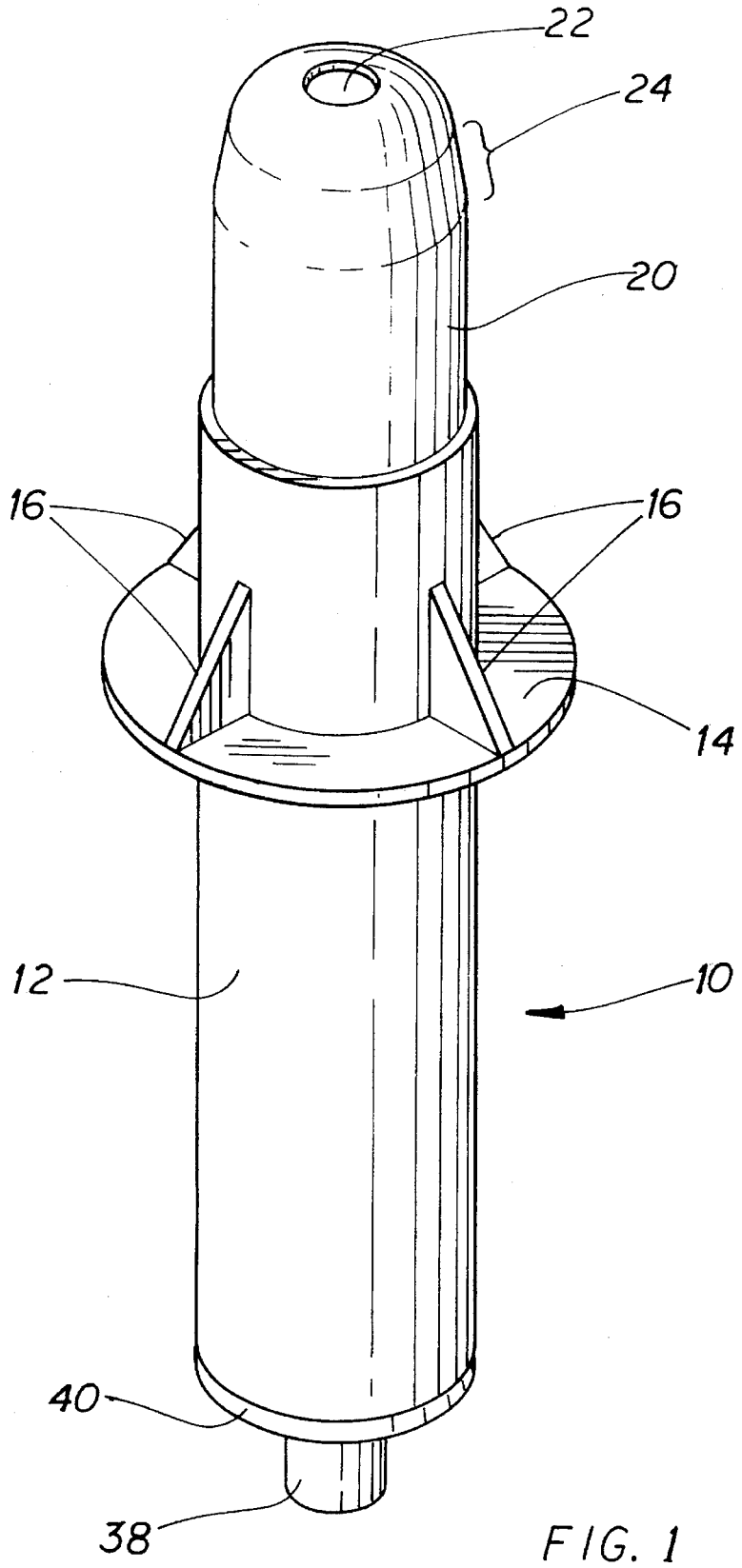
FIG. 1 is a perspective view of the tool.

Referring to FIG. 1, the standard tool, generally designated by the numeral 10, is dimensioned to fit a standard (also known as "regular" or "Edison base") light bulb. The tool comprises a handle portion 12 preferably composed of a semi-rigid plastic such as PVC. A collar 14 surrounds the handle 12 at a intermediate portion thereof, and is provided with stiffening ribs 16 to increase the rigidity of the handle 12. The collar 14 is preferably disposed toward the head 18 of the tool, so that it also serves to protect the user's hand from shards of glass which may break off during the removal process.

Figure 5:
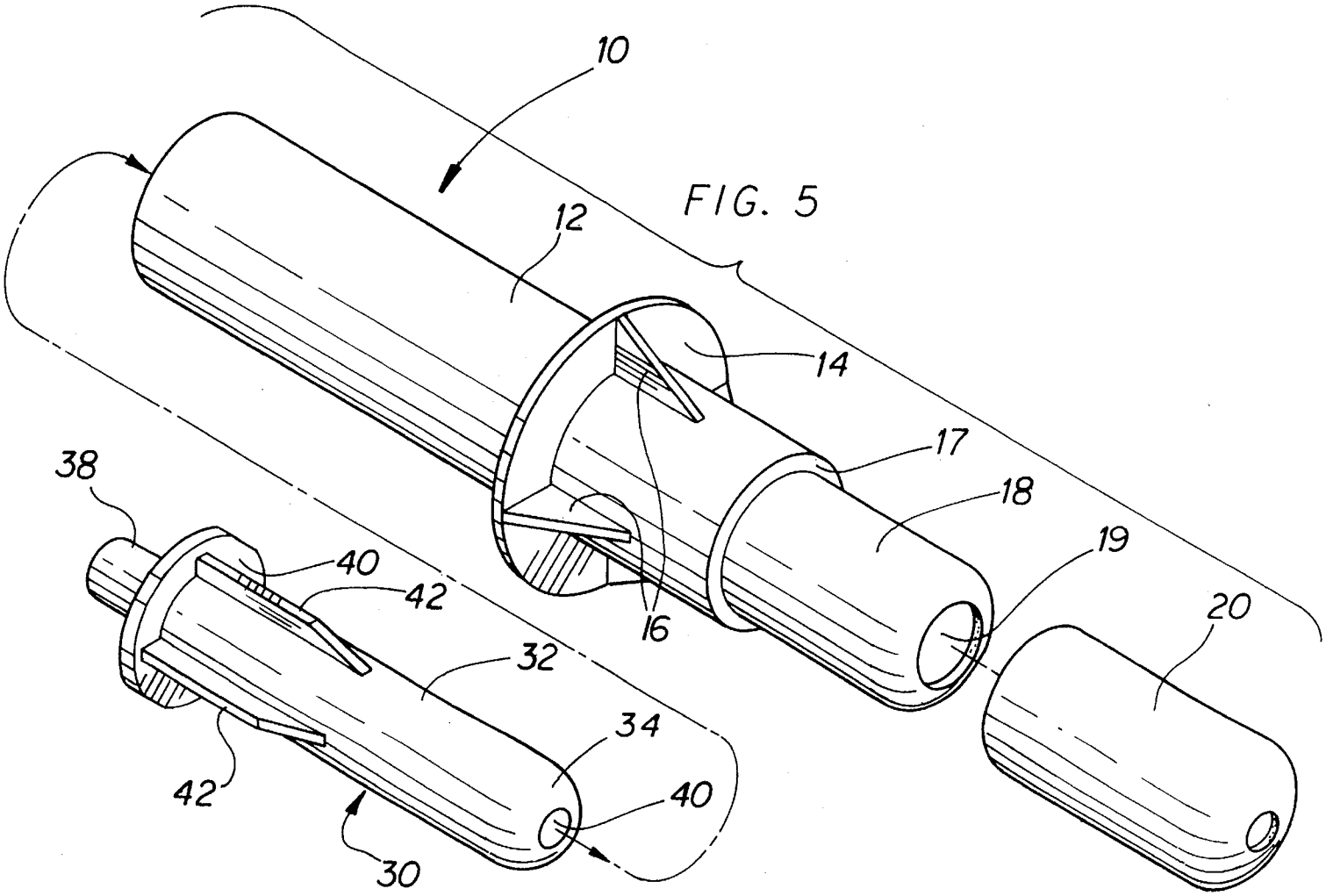
FIG. 5 is an exploded view of the tool.
Figure 6:
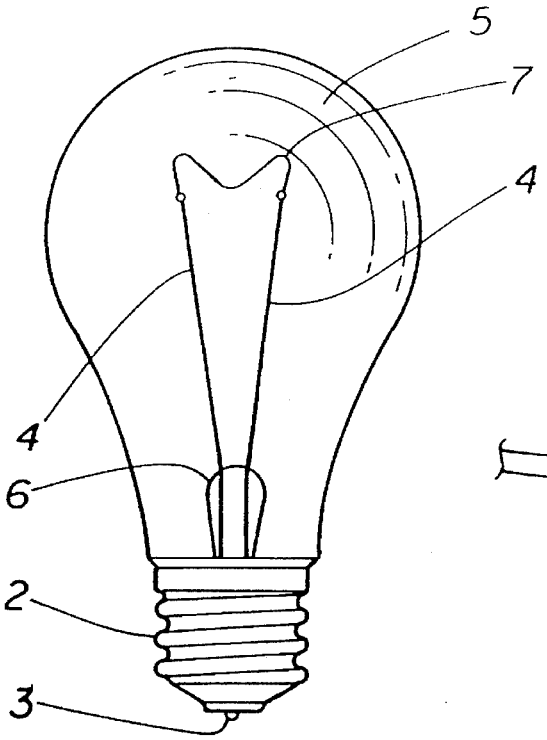
FIG. 6 is a side elevation of a typical incandescent light bulb.

The head 18, which can be seen in FIG. 5, is provided with an opening 19 disposed along generally the axis of the handle 12, for reasons which will be described below. The head 18 is preferably smaller in diameter than the handle 12, to accommodate the resilient gripping member 20. Preferably the handle 12, collar and ribs 14, 16 and head 18 of the tool 10 are integrally formed or extruded for economy of manufacture and structural integrity.

The gripping member 20 is essentially a cap composed of a somewhat more resilient plastic, silicone, rubber or the like. It is dimensioned to snugly enshroud the head 18, and the head 18 is in turn dimensioned so that the outer circumference of the gripping member 20 when engaged over the head 18 will approximate the inner circumference of the base 2 of a standard light bulb.

Because the gripping member 20 is resilient, it can be formed with its outer circumference approximately the same as that of the head 18, as seen in FIG. 5. Thus, when engaged over the head 18, as in FIG. 1, the gripping member 20 stretches somewhat to provide a good frictional engagement with the head 18. The gripping member 20 includes an opening 22 disposed axially relative to the handle 12 such that the opening 22 is generally aligned with the opening 19 in the head 18.

Figure 8:
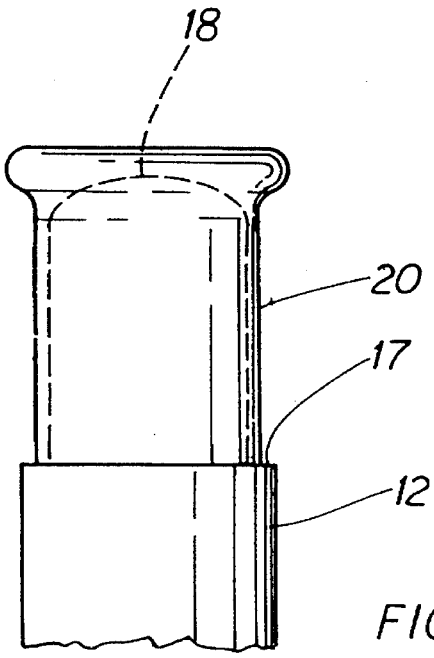
FIG. 8 is an enlarged view of the gripping member in the position shown in FIG. 7.

The gripping member 20 is preferably somewhat longer than the head 18, so that when fully engaged over the head 18 the tip of the gripping member 20 extends beyond the head 18 leaving a resilient "pocket" portion 24 at the tip of the gripping member 20, as seen in FIG. 1. This allows the gripping member 20 to compress toward the head 18 as the tool is lodged into the base of a light bulb, to provide additional gripping strength between the gripping member 20 and the base 2. This also allows for a bit of difference in the size of the gripping member 20 relative to the base 2. Pressing the tip of the gripping member 20 against the tip of the head, which occurs when the head 18 is inserted into a light bulb base 2 and the gripping member 20 presses against the bottom of the glass bulb 5 also slightly expands the gripping member 20 radially, as shown in FIG. 8, which further improves its ability to grip the interior wall of the base 2. Thus, the head 18 is preferably of a slightly smaller diameter than the handle 12, providing a ledge 17 against which the gripping member 20 is seated when fully engaged over the head 18, to preserve the compressible pocket 24 at the tip of the gripping member 20.

Figure 7:
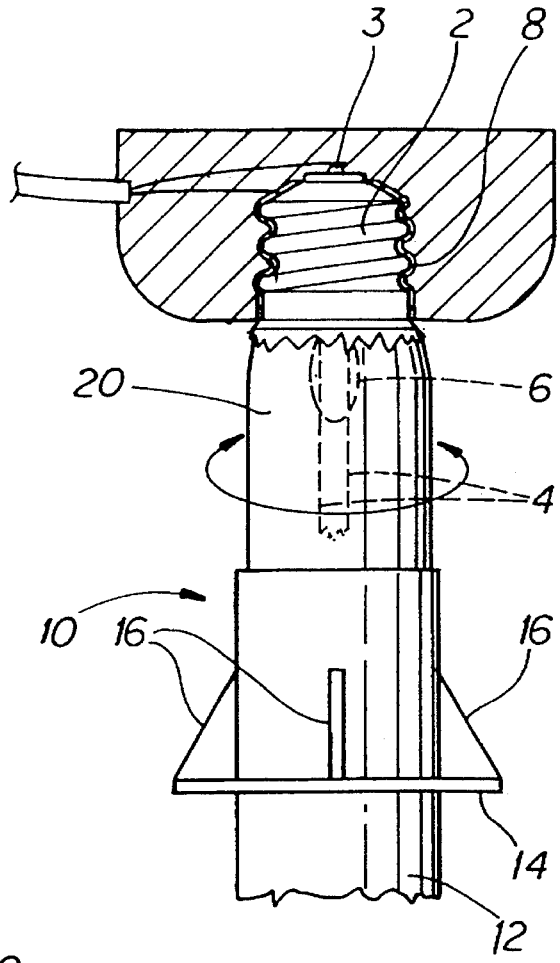
FIG. 7 is a partial side elevation of the tool engaged in the base of a broken light bulb for removal thereof from its socket.

In operation, the gripping member 20 is engaged over the head 18. The user grips the handle 12 and inserts the gripping member 20 into the base of a broken light bulb, as illustrated in FIG. 7, pinching the lead-in wires 4 together if necessary to ensure that the lead-in wires 4 and the pinch 6 extend through the openings 22 and 19, so that they are not crushed during insertion of the tool 10. The gripping member 20 thus frictionally engages the interior wall of the light bulb base 2, and upon rotation of the tool 10 in the appropriate (counterclockwise) direction, the base 2 is readily removed from the socket 8 without any danger of electrocution or other injury to the user. (It is nevertheless advisable to cut off power to the light prior to removing the broken bulb.)

Figure 4:
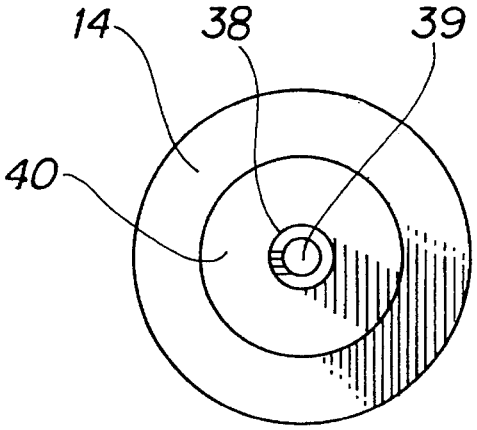
FIG. 4 is a rear elevation.

In a preferred embodiment the end of the handle 12 opposite the head 18 of the standard tool 10 is open and the handle 12 is hollow. An accessory tool 30, which may be composed of the same plastic as the handle 12, comprises a cylindrical body 32 having one end 34 dimensioned to fictionally engage the interior of a small (also known as "intermediate") light bulb base 2, being provided with an opening 36 for insertion of the lead-in wires 4 and pinch 6, and the other end 38 being dimensioned to frictionally engage the interior of a miniature (also known as "candelabra") light bulb base 2, also having an opening 39 (seen in FIG. 4) for insertion of the lead-in wires 4 and the pinch 6. In the case of the accessory tool, because of the small sizes of the light bulbs for which it is designed it is generally unnecessary to provide resilient gripping members over the ends; the semi-rigid plastic used to form the body 32 should be sufficiently resilient to frictionally engage the base of the light bulb and apply the lesser force (relative to the force required for a standard sized light bulb) necessary to dislodge the base 2 from the socket 8. However, if desired resilient gripping members may be provided for either or both ends 34, 38 of the accessory tool 30.

Figure 2:
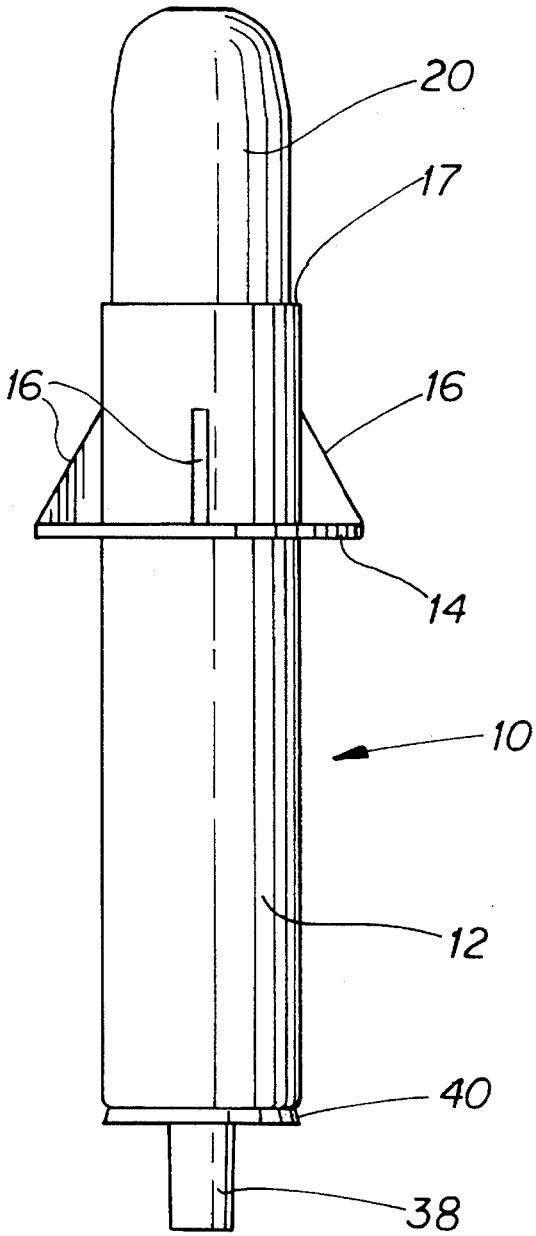
FIG. 2 is a side elevation of the tool of FIG. 1.
Figure 3:
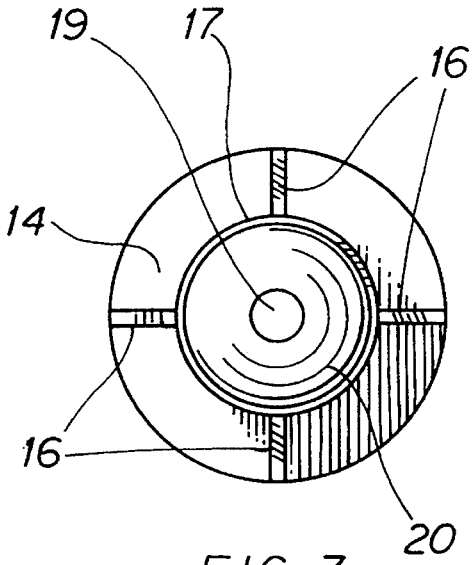
FIG. 3 is a front elevation.

The accessory tool 30 is provided with a rigidifying collar 39 and ribs 42, again serving the dual purpose of imparting rigidity to the accessory tool body 32 and protecting the user's fingers from shards of glass during the removal process. The ribs 42 in this instance are longer than the ribs 16 of the standard tool 10, and are dimensioned to frictionally engage the interior wall of the handle 12 with an interference fit, so that the accessory tool 30 can be lodged in the open end of the handle 12, as seen in FIG. 2, and is thus readily available for the removal of small and miniature size broken light bulbs. The operation of the accessory tool 30 is the same as that described above with respect to the standard tool 10.

The preferred embodiment of the invention having been thus described by way of example only, it will be apparent to those skilled in the art that certain modifications and adaptations may be made without departing from the scope of the invention, as set out in the appended claims. It will also be apparent that, depending upon the type of plastic used for the tool 10, the gripping member may be unnecessary in many applications.

We claim:

1. A tool for removing a broken incandescent light bulb from a socket, comprising a handle having a head projecting from one end, the head being dimensioned to fit within the base of the light bulb, a resilient gripping member formed from a resilient plastic dimensioned to snugly enshroud the head of the tool, whereby when the head is inserted into the base of a broken light bulb the gripping member frictionally engages an inner wall of the base to permit rotation of the base within the socket by rotating the handle.

2. The tool of claim 1 wherein the head and the gripping member are each provided with openings disposed approximately along an axis of the handle.

3. The tool of claim 1 in which the resilient gripping member is provided with an opening coaxial with an opening in the head of the tool.

4. The tool of claim 3 wherein the head has a smaller circumference than the handle providing a ledge against which the gripping member is seated when engaged over the head.

5. The tool of claim 1 including a collar surrounding the handle.

6. The tool of claim 5 wherein stiffening ribs extend between the handle and the collar.

7. The tool of claim 1 wherein the handle is formed from a semi-rigid plastic.

8. The tool of claim 1 wherein the handle is formed integrally with the head.

9. The tool of claim 6 wherein the handle, collar, ribs and head are formed integrally.

10. The tool of claim 1 wherein an end of the handle opposite the head is open and the handle is hollow.

11. The tool of claim 10 including an accessory tool dimensioned to fit within the hollow handle and frictionally engage an interior wall thereof, the accessory tool being provided with at least one head dimensioned to fit within a base of a light bulb smaller than the light bulb for which the tool is dimensioned.

12. The tool of claim 11 wherein the accessory tool is provided with a different size head on each end.

13. The tool of claim 12 wherein the accessory tool is provided with a collar surrounding a body of the accessory tool.

14. The tool of claim 12 wherein the accessory tool is provided with stiffening ribs dimensioned to frictionally engage the inner wall of the handle.

15. A tool for removing a broken incandescent light bulb from a socket, comprising a handle having a head projecting from one end, the head being dimensioned to fit within the base of the light bulb, a resilient gripping member dimensioned to snugly enshroud the head of the tool, the gripping member being provided with an opening coaxial with an opening in the head of the tool, the head having a smaller circumference than the handle providing a ledge against which the gripping member is seated when engaged over the head, whereby when the head is inserted into the base of a broken light bulb the gripping member frictionally engages an inner wall of the base to permit rotation of the base within the socket by rotating the handle.

16. A tool for removing a broken incandescent light bulb from a socket, comprising a handle having a head projecting from one end, the head being dimensioned to fit within the base of the light bulb, a resilient gripping member dimensioned to snugly enshroud the head of the tool, a tip of the gripping member being spaced from the head such that when engaged over the head a pocket is formed whereby the tip of the gripping member can be compressed against the head to expand the gripping member radially, whereby when the head is inserted into the base of a broken light bulb the gripping member frictionally engages an inner wall of the base to permit rotation of the base within the socket by rotating the handle.

17. The tool of claim 16 wherein the head and the gripping member are each provided with openings disposed approximately along an axis of the handle.

18. The tool of claim 16 wherein the head has a smaller circumference than the handle providing a ledge against which the gripping member is seated when engaged over the head.

19. The tool of claim 16 including a collar surrounding the handle.

* * * * *